US006169561B1

(12) United States Patent
Fisher, Sr.

(10) Patent No.: US 6,169,561 B1
(45) Date of Patent: Jan. 2, 2001

(54) IMAGE FORMING APPARATUS AND RECEIVER TRAY CAPABLE OF AUTOMATICALLY ACCOMMODATING RECEIVER SHEETS OF VARIOUS SIZES AND METHOD OF ASSEMBLING SAME

(75) Inventor: Terrence L. Fisher, Sr., Rochester, NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/069,673

(22) Filed: Apr. 29, 1998

(51) Int. Cl.[7] ..... B41J 13/10

(52) U.S. Cl. ..... 347/218; 347/164; 271/171; 399/381

(58) Field of Search ..... 347/218, 264, 347/262, 164, 104; 399/381; 271/145, 164, 171, 223

(56) References Cited

U.S. PATENT DOCUMENTS

| | | |
|---|---|---|
| 3,919,972 | 11/1975 | Komori et al. . |
| 5,332,209 | 7/1994 | Romansky et al. . |
| 5,398,108 | 3/1995 | Morinaga et al. . |
| 5,537,195 | 7/1996 | Sagara et al. . |

*Primary Examiner*—Huan Tran
(74) *Attorney, Agent, or Firm*—Walter S. Stevens

(57) ABSTRACT

Image forming apparatus and receiver tray capable of automatically accommodating receiver sheets of various sizes, and method of assembling same. The tray includes a housing having a lateral sidewall and a rear sidewall. The tray also includes a resilient first alignment member disposed adjacent the lateral sidewall of the housing for abutting a lateral marginal edge of the stack. The tray further includes a resilient second alignment member and a resilient third alignment member both adjacent the rear wall of the housing. If a sheet of a first size (e.g., "A4-sized") is loaded onto the platen, the lateral marginal edge of the sheet will abut the first alignment member and a rearwardly-facing marginal edge of the sheet will rest atop and compress the second alignment member; however, the rearwardly-facing marginal edge of the sheet will abut the third alignment member. Similarly, if a sheet of a second size ("letter-sized") is loaded onto the platen, the lateral marginal edge of the sheet will rest atop and compress the resilient first alignment member; however, the rearwardly-facing marginal edge of the sheet will compress the second alignment member and abut the third alignment member. For most commonly used sizes of receiver sheets, mere placement of a stack of receiver sheets onto the platen achieves automatic alignment of the stack with a picker mechanism belonging to the image forming apparatus without manual adjustment of any other component of the tray.

14 Claims, 7 Drawing Sheets

IMAGE FORMING APPARATUS AND RECEIVER TRAY CAPABLE OF AUTOMATICALLY ACCOMMODATING RECEIVER SHEETS OF VARIOUS SIZES AND METHOD OF ASSEMBLING SAME

BACKGROUND OF THE INVENTION

The present invention generally relates to image forming apparatus and methods and more particularly relates to an image forming apparatus including receiver supply tray capable of automatically accommodating receiver sheets of various sizes, and method of assembling same.

An image forming apparatus may be a thermal printer which forms a color print by successively printing with a dye donor onto individual sheets of a dye receiver (i.e., paper or transparency). The print head of such a thermal printer commonly provides a print line of thermal resistive elements that can be individually heated in order to transfer dye from the donor to the receiver.

More specifically, a typical color thermal printer includes the previously mentioned print head and a platen. A picker mechanism "picks" individual sheets of the receiver from a stack of cut sheets of the receiver and feeds the individual sheets into a nip area defined between the print head and platen. The donor is positioned between the print head and platen. The print head is then lowered, so that the donor and receiver sheet are sandwiched between the print head and platen. An image is printed on the sheet by selectively heating the elements of the print head in order to transfer a first dye to the receiver sheet. The receiver sheet is then repositioned to receive a second color of the image, and the donor is positioned to provide a second dye color. These steps are repeated until all colors of the image are printed and the completed print is ejected from the printer.

Moreover, a receiver cassette tray loaded with the stack of cut receiver sheets is removably inserted into the printer. The tray includes a spring loaded support plate (i.e., platen) supporting the stack of sheets. The support plate upwardly biases the stack of sheets into engagement with the picker mechanism, so that the picker mechanism can pick individual sheets from the stack of sheets. It is known that the stack of sheets should reside in the tray such that the marginal edges of each sheet generally aligns with the marginal edges of the other sheets in the stack of sheets. Such alignment is desirable so that each sheet is properly presented to the picker mechanism for picking. Proper presentment of each sheet to the picker mechanism in turn decreases likelihood that sheets will "jam" in the picker mechanism when the sheets engage the picker mechanism. Moreover, it is desirable that receiver supply trays be able to accommodate receiver sheets of various sizes, such as sheets that, for example, are "letter-sized" having dimensions of 8.50 inches (21.59 cms) wide by 11 inches (27.94 cms) long or "A4-sized" sheets having dimensions of 8.27 inches (21 cms) wide by 11.69 inches (29.7 cms) long. To accommodate sheets of different sizes, prior art receiver supply trays include manually adjustable sheet "restricter" members therein.

A cassette for accommodating receiver sheets is disclosed in U.S. Pat. No. 5,537,195 titled "Sheet-Accommodating Cassette With Main Container And Sub Container" issued Jul. 16, 1996 in the name of Seiji Sagara, et al. This patent discloses a sheet-accommodating cassette used in an image forming apparatus, such as a copying machine or a printer, for accommodating sheets supplied to the image-forming apparatus. The Sagara, et al. device includes a main container and a subcontainer coupled to each other to form the sheet-accommodating cassette. A rear "end-restricting member" is manually engageable with any of several engagement holes in the sub-container for restricting the rear end of the sheets. In addition, a "side-restricting member" can be manually brought into engagement with an engagement hole formed in the main container for accommodating letter size sheets. Moreover, the side-restricting member also can be brought into engagement with another engagement hole for accommodating A4 size sheets. Also, the side-restricting member can be manually brought into engagement with yet another engagement hole for accommodating B5 size sheets. Thus, to accommodate a sheet of a given length, the end and side-restricting members are manually moved, such that they engage sets of appropriate engagement holes. Therefore, the Sagara et al. device requires manual repositioning of the end and side-restricting members to accommodate sheets of various sizes. However, manually repositioning the end and side-restricting members is time consuming and therefore costly. Hence, a problem in the art is time consuming and costly manual repositioning of end-restricting and side-restricting members in a receiver sheet cassette when it is necessary to load sheets of different sizes.

Therefore, there has been a long felt need to provide an image forming apparatus including receiver supply tray capable of automatically accommodating receiver sheets of various sizes, and method of assembling same.

SUMMARY OF THE INVENTION

An object of the present invention is to provide an image forming including receiver supply tray capable of automatically accommodating receiver sheets of various sizes, and method of assembling same.

With the above object in view, the invention resides in an image forming apparatus capable of automatically accommodating a receiver having a predetermined size, comprising a print head for printing an image on the receiver; and a receiver supply tray associated with the print head for accepting the receiver, the supply tray adapted to automatically accommodate the receiver size.

According to one aspect of the present invention, the tray includes a housing having a rear wall and two parallel sidewalls perpendicular to the rear wall. A platen is movably connected to the housing for supporting a stack of receiver sheets thereon, each receiver sheet having two lateral marginal edges, a rearwardly-facing marginal edge and a front-facing marginal edge. The tray includes a resilient first leaf spring adjacent one of the sidewalls of the housing for aligning one lateral marginal edge of the stack and further includes a side panel adjacent the other sidewall for aligning the other marginal edge of the stack. The tray also includes a resilient second leaf spring and a resilient third leaf spring parallel to the second leaf spring. Both the second and third leaf springs are disposed adjacent the rear wall of the housing for aligning the rearwardly-facing marginal edge of the stack of sheets.

If the receiver sheets which are loaded onto the platen are 8.5 inches wide by 11.0 inches long (i.e., "letter-sized"), the lateral marginal edge of the stack of sheets will rest atop and compress the first leaf spring disposed near one sidewall and will abut the side panel near the other sidewall. The rearwardly-facing marginal edge of the stack of sheets will abut a side edge of the resilient second leaf spring disposed near the rear wall. Thus, in the case of letter-sized sheets, one marginal edge thereof will compress the first leaf spring due to its relatively wider width compared to A4-sized sheets and will abut the side edge of the second leaf spring due to its relatively shorter length compared to A4-sized sheets. Of course, the other marginal edge of the sheets will abut the side panel. As another example, if the receiver sheets which are loaded onto the platen are 8.27 inches wide by 11.69 inches long (i.e., "A4-sized"), a lateral marginal edge of the stack of sheets will abut a side edge of the resilient first leaf spring disposed near one sidewall and will abut the side panel near the other sidewall. In this case, the rearwardly-facing marginal edge of the sheet will rest atop and compress the second leaf spring but abut a side edge of the third leaf spring. Thus, in the case of A4-sized sheets, one marginal edge thereof will abut the side edge of the first leaf spring due to its relatively narrower width compared to letter-sized sheets and will compress the second leaf spring but abut the side edge of the third leaf spring due to its relatively longer length compared to letter-sized sheets. That is, for the most commonly used sizes of receiver sheets (i.e., letter-sized and A4-sized), mere placement of a stack of receiver sheets onto the tray's platen achieves automatic alignment of the stack with the picker mechanism without manual adjustment of any "end-restricting member" or "side-restricting member". In this manner, a receiver supply tray is provided that is capable of automatically accommodating a stack of receiver sheets of various sizes.

A feature of the present invention is the provision of a receiver supply tray including a plurality of leaf springs adapted to automatically accommodate receiver size.

An advantage of the present invention is that printing costs are reduced.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
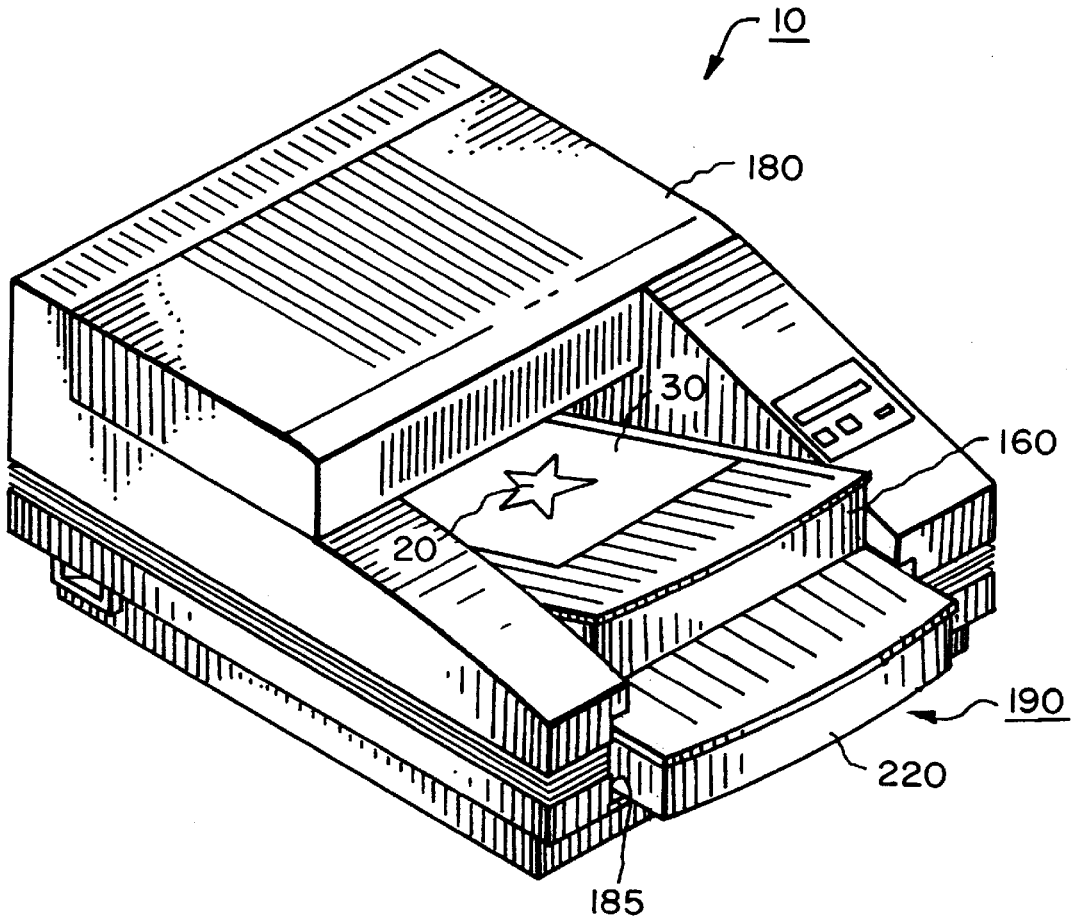
FIG. 1 is a view in perspective of an image forming apparatus belonging to the present invention, the apparatus having a receiver supply tray disposed thereinto.
Figure 2:
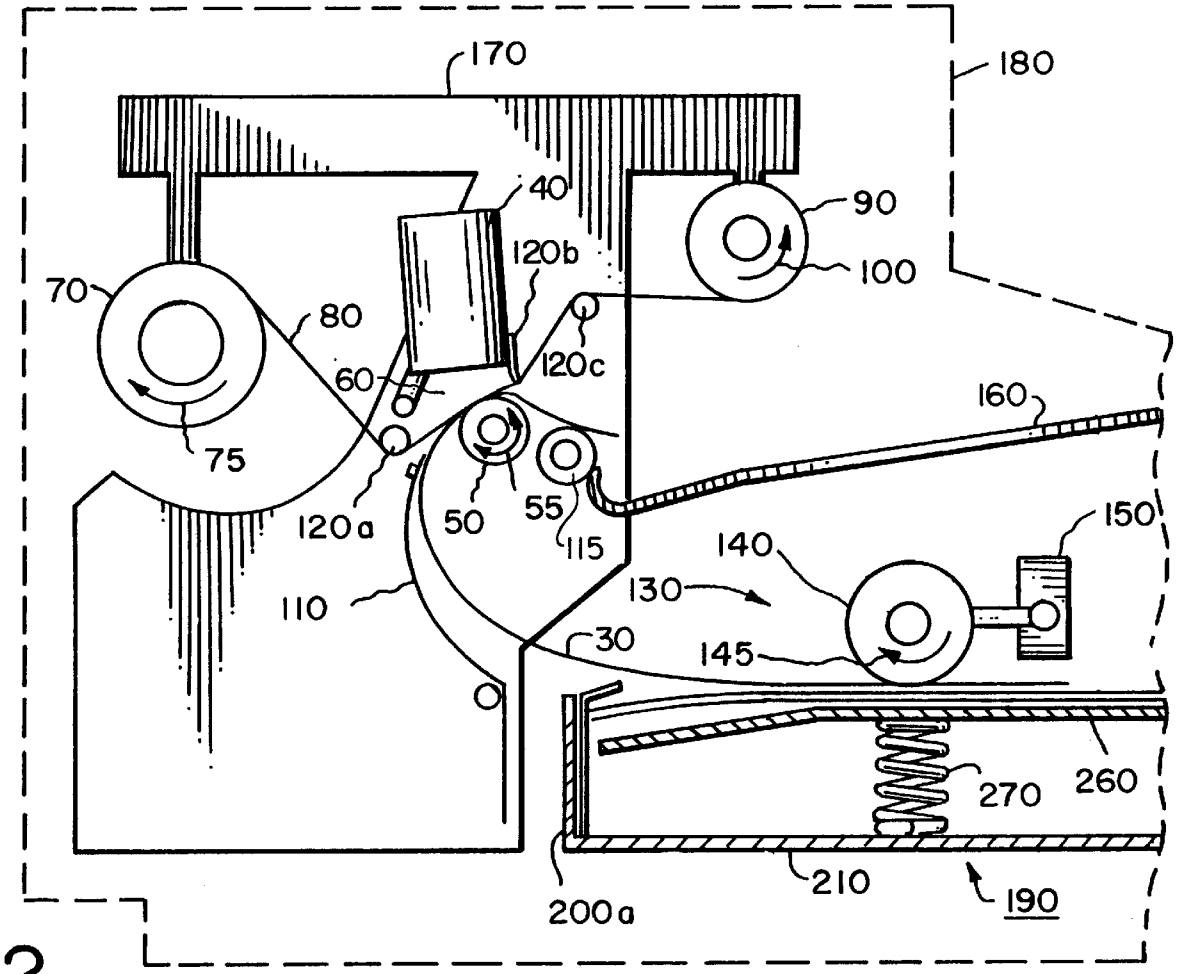
FIG. 2 is a view in vertical section of the apparatus with parts removed for clarity.
Figure 3:
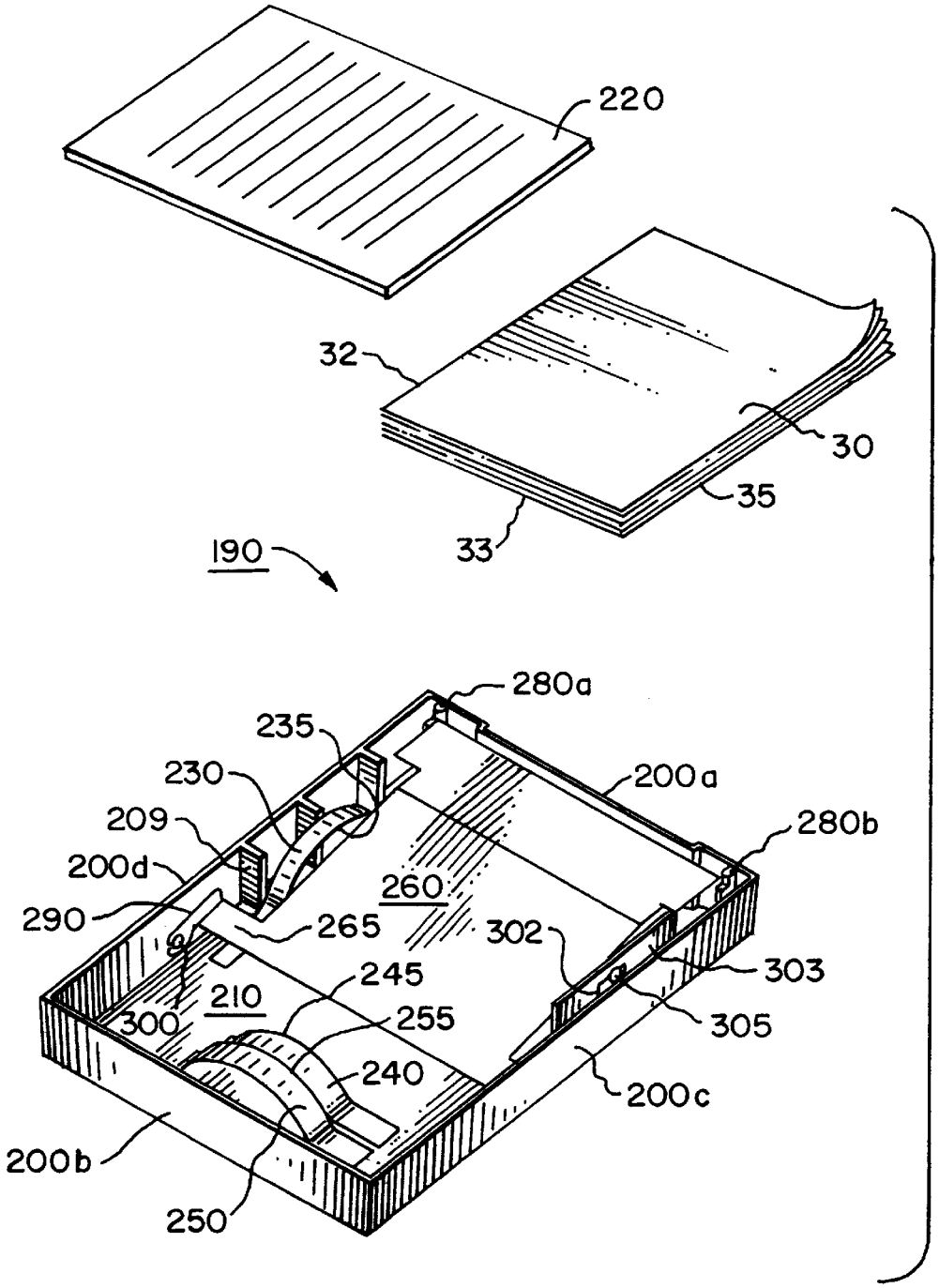
FIG. 3 is an expanded view in perspective of the receiver supply tray, this view showing a stack of receiver sheets to be accepted into the tray and a tray cover to cover the stack of sheets.

Therefore, referring to FIGS. 1, 2 and 3, there is shown a thermal resistive printer, generally referred to as 10, for forming an image 20 on a receiver sheet 30 which may be paper or transparency. Each receiver sheet 30 has a lateral marginal edge 32 and a rearwardly-facing marginal edge 33. The terminology "rearwardly-facing marginal edge", as used herein, is fully defined hereinbelow. A plurality of receiver sheets 30 define a stack 35 of receiver sheets. Printer 10 comprises a thermal resistive print head 40 formed of a plurality of resistive heating elements (not shown), for reasons disclosed hereinbelow. Disposed opposite print head 40 is a support 50 for supporting and transporting receiver sheet 30 through printer 10, which support 50 is adapted to rotate bi-directionally as shown by a double-headed first arrow 55. In this regard, support 50 may be connected to a reversible motor (not shown) for rotating support 50 bi-directionally. Print head 40 and support 50 define a collapsible nip 60 therebetween for passage of receiver sheet 30 therethrough. In this regard, nip 60 is capable of being opened and closed when print head 40 is upwardly and downwardly moved, respectively, with respect to support 50. Receiver sheet 30 is reversibly transported through nip 60 by means of engagement with rotatable support 50. As receiver sheet 30 is transported through nip 60, the nip 60 is closed and the previously mentioned heating elements are activated to cause printing of image 20 onto receiver sheet 30, as described in more detail hereinbelow.

As best seen in FIG. 2, printer 10 further comprises a dye donor supply spool 70 adapted to freely rotate in a direction of a second arrow 75. Wound about donor supply spool 70 is a dye donor ribbon 80 containing a plurality of dye-containing color patches (not shown). Disposed relative to donor supply spool 70 is a dye donor take-up spool 90 adapted to rotate in a direction of a third arrow 100. Donor take-up spool 90 draws donor ribbon 80 from donor supply spool 70 to take-up spool 90 as take-up spool 90 rotates. It may be understood that as take-up spool 90 draws donor ribbon 80 from donor supply spool 70, ribbon 80 will pass through nip 60 between receiver sheet 30 and print head 40. It may be further understood that as nip 60 closes, the previously mentioned heating elements in print head 40 are enabled such that radiative heat therefrom causes dye to transfer from ribbon 80 to receiver sheet 30 in order to form image 20 on receiver sheet 30. That is, as ribbon 80 is sandwiched between print head 40 and receiver sheet 30, image 20 is printed by selectively heating individual ones of the heating elements in print head 40 in order to transfer a first dye to receiver sheet 30. Receiver sheet 30 is then repositioned by means of rotating support 50 to receive a second color of the image, and ribbon 80 is positioned by means of rotating take-up spool 90 to provide a second dye color. These steps are repeated until all colors of image 20 are printed and the completed print is ejected from printer 10.

Referring yet again to FIG. 2, movement of ribbon 80 through nip 60 and enablement of the heating elements in print head 40 are preferably synchronized to transfer the dyes from ribbon 80 to receiver sheet 30 at the desired times and predetermined locations on receiver sheet 30. Therefore, a control unit (not shown) is connected to print head 40 for controlling print head 40, so that the heating elements are enabled when desired. Also, the control unit may be connected to print head 40 for upwardly and downwardly moving print head 30 in order to open and close nip 60 when required. The control unit may also be connected to take-up spool 90 for controlling take-up spool 90, so that operation of take-up spool 90 is synchronized with operation of print head 40.

Still referring to FIG. 2, printer 10 also comprises a guide ramp 110 and a freely rotatable guide roller 115 aligned with nip 60 for guiding receiver sheet 30 into and through nip 60, respectively. In addition, a plurality of tensioners 120*a*, 120*b* and 120*c* are provided for tensioning ribbon 80. Also, a feeder mechanism, generally referred to as 130, is provided for "picking" individual receiver sheets 30 from stack 35 and feeding receiver sheets 30 onto guide ramp 110. Feeder mechanism 130 includes a picker roller 140 rotatable in a direction of a fourth arrow 145 by means of a motor 150. Moreover, an output receptacle 160 is positioned to receive sheet 30 when image 20 is completely printed thereon. Print head 40, support 50, supply spool 70, take-up spool 90, guide 110, guide roller. 115, tensioners 120*a*/*b*/*c*, and feeder mechanism 130 are preferably connected to a frame 170 for supporting these components within printer 10. These components, including frame 170, are enclosed within a printer enclosure 180 for protecting the components from damage, which enclosure 180 has an opening 185 for reasons disclosed hereinbelow.

Referring to FIGS. 1, 2, 3, 4, 5 and 6, the invention also comprises a receiver sheet supply tray, generally referred to as 190, for holding the stack 35 of receiver sheets, which tray 190 is sized to be received into opening 185 and thus into enclosure 180. Tray 190 includes a front sidewall 200*a* and a rear sidewall 200*b* parallel to front sidewall 200*a*. Interposed between front sidewall 200*a* and rear sidewall 200*b* are a first lateral sidewall 200*c* and a second lateral sidewall 200*d*, the second lateral sidewall 200*d* being parallel to first lateral sidewall 200*c* and spaced-apart therefrom. Attached to second lateral sidewall 200*d* are a row of outwardly projecting alignment pillars 209, for reasons disclosed hereinbelow. Tray 190 also includes a floor 210 integrally attached to sidewalls 200*a*/*b*/*c*/*d*. Tray 190 may further include a removable cover plate 220 extending from first lateral sidewall 200*c* to second lateral sidewall 200*d* and resting thereon for protecting stack 35 of sheets from fouling by external dirt, dust and the like while tray 190 is received into but partially projecting from opening 185.

Referring to FIGS. 3, 4, 5 and 6, disposed inwardly of sidewall 200*d* and row of alignment pillars 209, and extending parallel thereto, is a resilient upright first alignment member 230 having a contact edge 235, as described in more detail hereinbelow. The purpose of first alignment member 230 is to align lateral marginal edges 32 of stack 35 by abutting marginal edges 32 on contact edge 235. This achieves alignment of each sheet 30 with picker roller 140. In this manner, picker roller 140, which belongs to feeder mechanism 130, is able to smoothly pick individual sheets 30 without "jamming" in feeder mechanism 130. Moreover, disposed inwardly of rear sidewall 200*b* and extending parallel thereto is a second alignment member 240 having a contact edge 245, for reasons described in more detail hereinbelow. Also disposed inwardly of sidewall 200*b* and extending parallel thereto, but interposed between second alignment member 240 and rear sidewall 200*b*, is a third alignment member 250 having a contact edge 255. The purpose of second alignment member 240 and third alignment member 250 is to align rearwardly-facing marginal edges 33 of stack 35 with respect to align each sheet 30 with picker roller 140 by abutting marginal edges 33 on contact edges 245 or 255, as described more fully hereinbelow. Thus, when marginal edges 32 and 33 of stack 35 are so aligned, picker roller 140 is able to pick individual sheets 30 without "jamming" sheets 30 in feeder mechanism 130. It may be appreciated that the terminology "rearwardly-facing marginal edge" is defined herein to mean that marginal edge of each sheet 30 which face rear sidewall 200*b* of tray 190.

Referring to FIGS. 2, 3, 4, 5, 6 and 7, disposed inwardly of sidewalls 200*a*/*b*/*c*/*d* is a movable platen 260 supported on floor 210 by at least one biasing member, such as a coiled spring 270, which upwardly biases platen 260 against stack 35. Platen 260 includes a pair of outwardly laterally projecting wing portions 265 integrally formed therewith, for reasons disclosed presently. Spring 270 is preferably attached both to platen 260 and floor 210, so that platen 260 remains at all times connected to tray 190. In addition, a lever arm 290 is pivotably attached, such by a first pivot pin 300, to each of sidewalls 200*c* and 200*d* for engaging wing portions 265. Furthermore, interposed between platen 260 and sidewall 200*c* is a side panel 303 having a slot 302 which is engaged by a second pivot pin 305 which is affixed to platen 260. Thus, as stack 35 is loaded upon platen 260, wing portions 265 will engage arms 290 which will pivot about pivot point 300 to a predetermined extent. When this occurs, resilient spring 270 will compress to a predetermined extent, so that platen 260 moves downwardly by weight of stack 35. However, as spring 270 compresses, spring 270 also upwardly biases platen 260. As spring 270 upwardly biases platen 260, stack 35 is pressed with a predetermined upwardly acting force against a pair of colinearly aligned separation pawls 280*a* and 280*b* which are adjustably connected to lateral sidewalls 200*c*/*d* by a coiled spring 202. Each separation pawl 280*a*/*b* includes a support wall 204 preferably slidable on floor 210 in a direction illustrated by a double-headed arrow 205. In this regard, support wall 204 slides outwardly away from lateral sidewalls 200*c*/*d* due to the biasing action of spring 202 in order to engage support wall 204 with lateral marginal edge 32 of sheets 30 when sheets 30 have narrower width such as 8.27 inches (21 cms). Similarly, support wall 204 slides inwardly against spring 270 toward lateral sidewalls 200*c*/*d* to accommodate receiver sheets 30 having a larger width, such as 8.50 inches (21.59 cms). In this manner, pawls 280*a*/*b* automatically adjust to the width of sheets 30 loaded into supply tray 190 without manual adjustment of pawls 280*a*/*b*. In addition, each support wall 204 may include a canted ramp portion 206 for easily and quickly sliding stack 35 thereover and under pawls 280*a*/*b*. In addition, a pair of guide blocks 208 may also be provided for guiding support wall 204 in the direction of arrow 205. Platen 260 and pawls 280*a*/*b* co-act to separate individual sheets 30 from stack 35 as sheets 30 are picked from tray 190 by picker roller 140. Also, if desired, only one pawl (e.g., pawl 280*b*) need be present for separating sheets 30 from stack 35.

Figure 4:
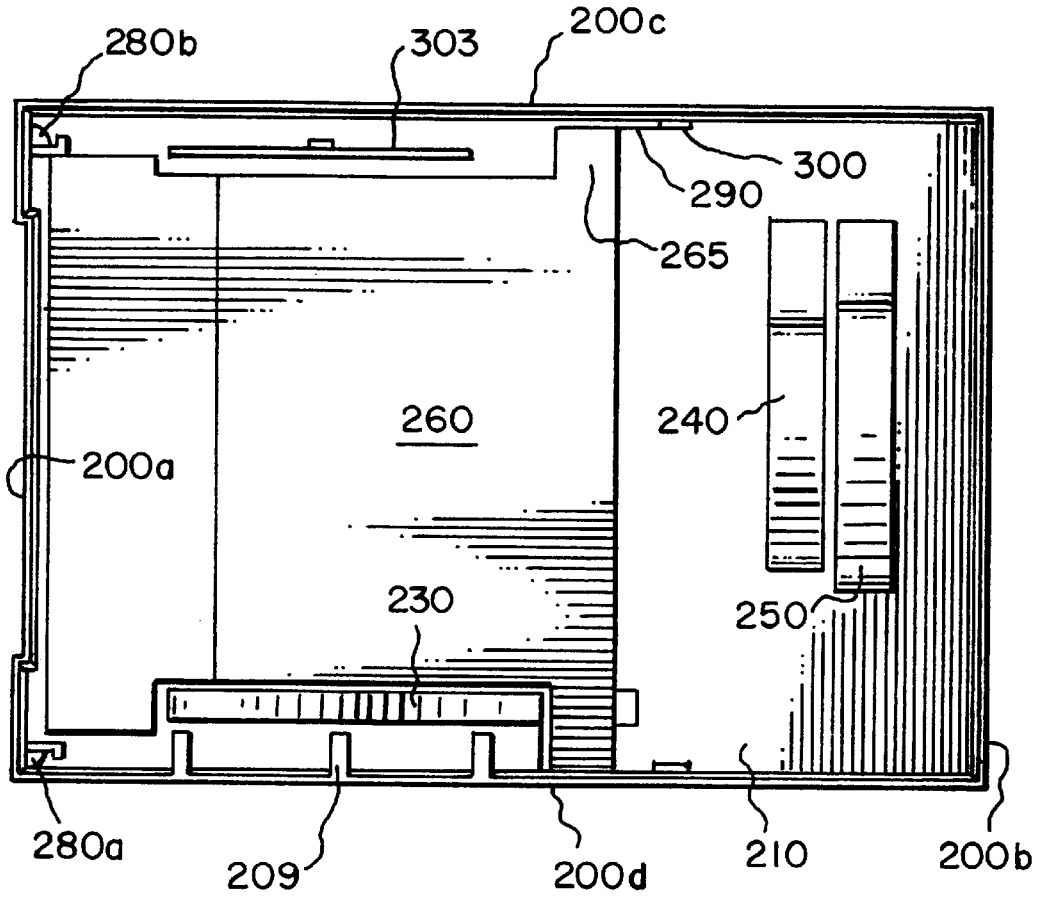
FIG. 4 is a plan view of the receiver supply tray with the cover and receiver sheets removed for purposes of clarity.
Figure 5:
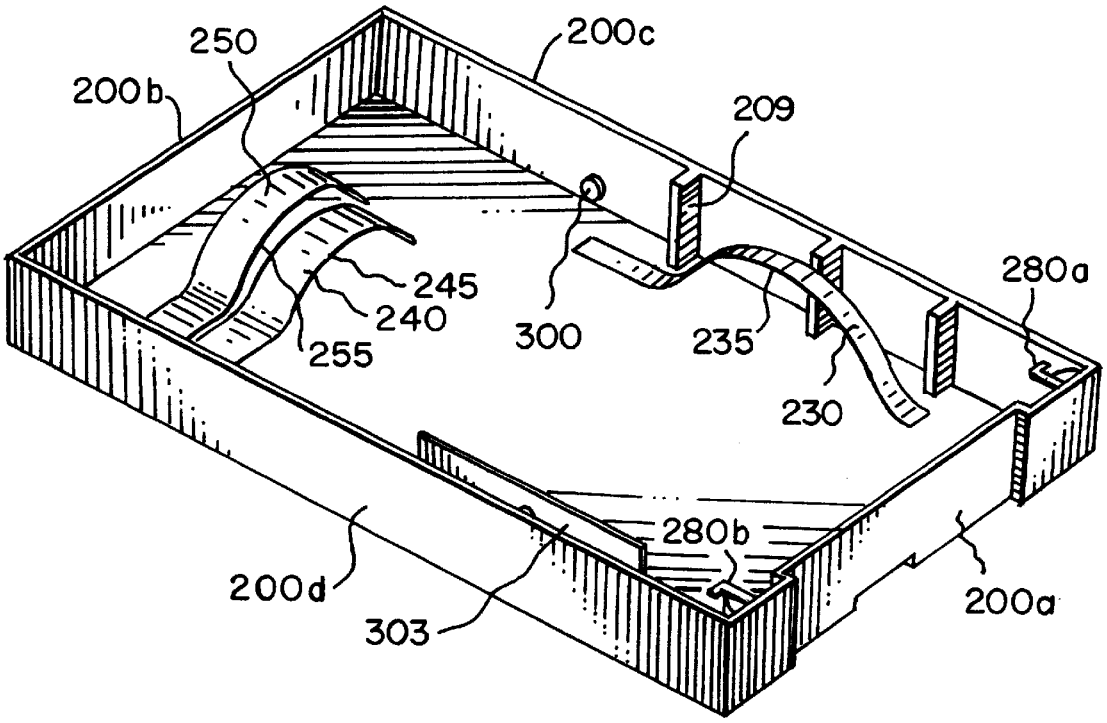
FIG. 5 is a view in perspective of the receiver supply tray with parts removed for clarity.
Figure 6:
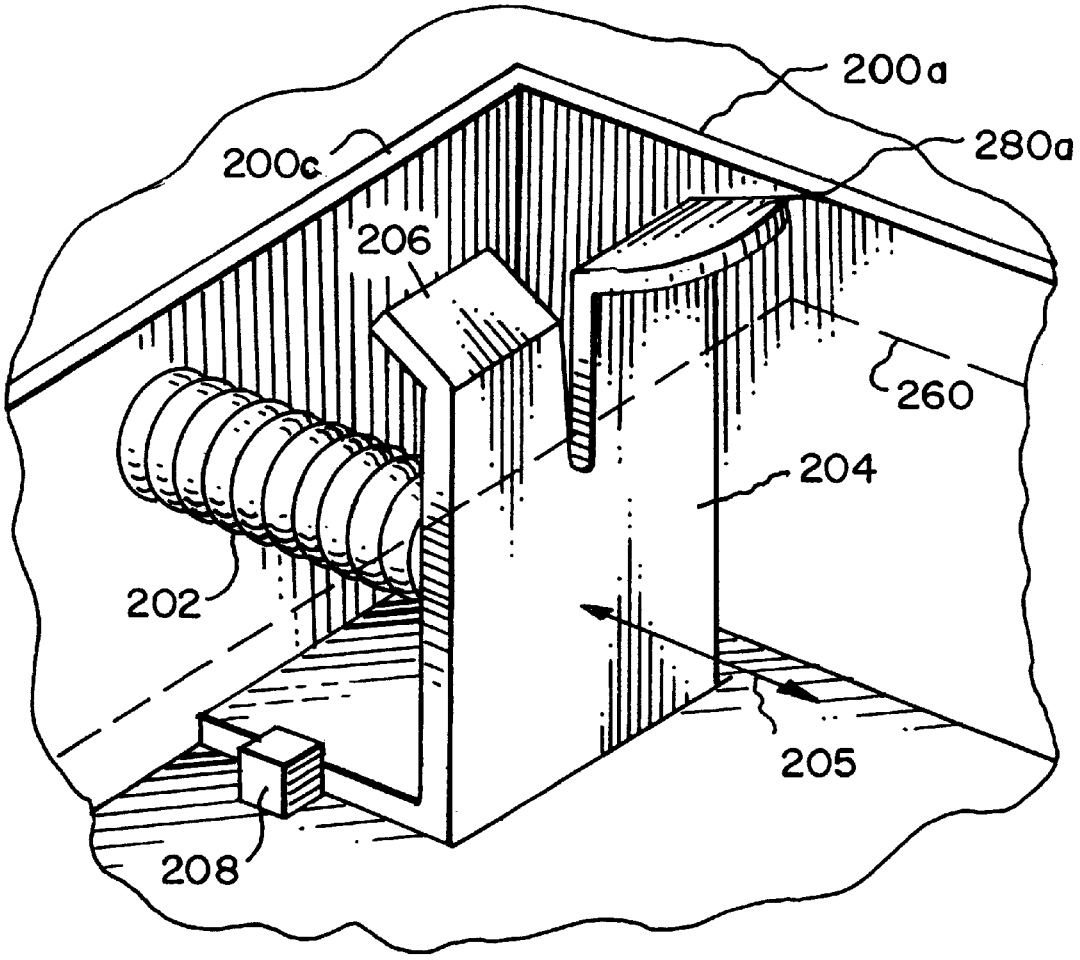
FIG. 6 is a view in perspective of a separation pawl for separating individual sheets from the stack of sheets.
Figure 7:
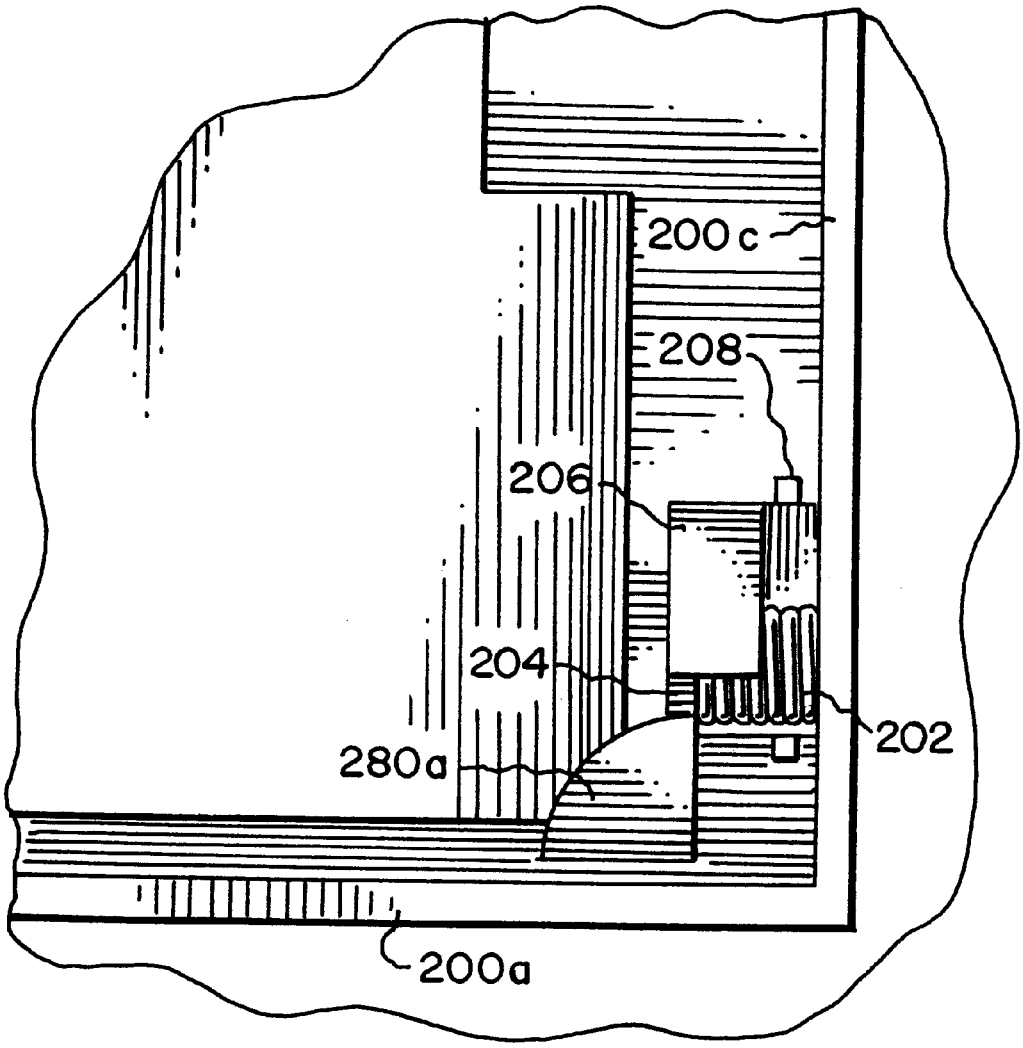
FIG. 7 is a plan view of the separation pawl.

As best seen in FIGS. 3, 4 and 5, alignment members 230/240/250 are preferably each upright and bowed resilient leaf springs having the previously mentioned contact edges 235/245/255, respectively. In this regard, contact edge 235 or alignment pillars 209 will abut lateral marginal edge 32 while stack 35 rests on platen 260, as described in more detail presently. In addition, contact edges 245 or 255 will abut rearwardly-facing marginal edge 33 while stack 35 rests on platen 260, as described in more detail presently. More specifically, when a relatively wide but short (e.g., approximately 8.50 inches wide by 11 inches long) stack 35 of "letter-sized" receiver sheets 30 is loaded onto platen 260, lateral marginal edge 32 will rest atop first alignment member 230 but abut alignment pillars 209. However, it may be appreciated that as stack 35 rests atop first resilient alignment member 230, the first resilient alignment member 230 will compress a predetermined amount to allow stack 35 to lower as platen 260 lowers. While this occurs, rearwardly-facing marginal edge 33 will abut contact edge 245 of second alignment member 240. Similarly, when relatively narrow but long (e.g., 8.27 inches wide by 11.69 inches long) stack 35 of "A4-sized" receiver sheets 30 is loaded onto platen 260, lateral marginal edge 32 will abut contact edge 235 and rearwardly-facing marginal edge 33 will abut contact edge 255. However, in this case, a rearward portion of stack 35 will rest atop second resilient alignment member 240. It may be appreciated that as the rearward portion of stack 35 rests atop second resilient alignment member 240, the second resilient alignment member 240 will compress a predetermined amount to allow stack 35 to lower as platen 260 lowers. It may be appreciated that stacks 35 having even longer lengths can be accommodated in tray 190, if desired. In this case, the rearward portion of stack 35 may rest upon both second alignment member 240 and third alignment member 250. When occurs, rearwardly-facing marginal edge 33 will abut rear sidewall 200*b*. In this case, lateral marginal edge 32 abuts either first alignment member 230 or pillars 209, as the case may be, depending on the width of stack 35. Also, it may be appreciated that, in this case, as stack 35 rests atop second and third resilient alignment members 240/250, the first and second resilient alignment members 240/250 will compress a predetermined amount to allow stack 35 to lower as platen 260 lowers. In addition, alignment members 230/240/250 are preferably bowed a predetermined amount for obtaining a predetermined resiliency. Thus, for the most commonly used sizes of receiver sheets, mere placement of stack 35 onto platen 260 achieves automatic alignment of stack 35 with feeder mechanism 130 without manual adjustment of any other component of tray 190.

It is understood from the description hereinabove that an advantage of the present invention is that printing costs are reduced. This is so because time spent to manually reposition so-called "end-restricting" or "side-restricting" members to achieve proper adjustment during loading of receiver sheets into a receiver supply tray is avoided. That is, for the most commonly used sizes of receiver sheets (e.g., letter-size and A4-size), mere placement of stack 35 onto platen 260 achieves automatic alignment of stack 35 with feeder mechanism 130 without adjustment of any other component of tray 190. In addition, printing costs are also reduced because the need for multiple receiver trays to accommodate sheets of various commonly-used sizes is lessened.

The invention has been described in detail with particular reference to certain preferred embodiments thereof, but it will be understood that variations and modifications can be effected within the spirit and scope of the invention. For example, tray 190 is disclosed herein as usable with a thermal resistive printer. However, it should be understood that tray 190 is equally usable with other types of imaging devices, such as resistive ribbon printers, laser printers and ink jet printers or wherever use of such a receiver supply tray is desirable. As another example, alignment members 230/240/250 are shown as leaf springs. However, alignment members 230/240/250 instead may be suitable spring-loaded structures. Also, although three alignment members 230/240/250 are disclosed, it should be understood that more or fewer alignment members may be provided, if desired. As a further example, although image forming apparatus 10 is disclosed herein as a printer in the preferred embodiment, it should be understood that image forming apparatus 10 may be a copier.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is an image forming apparatus including receiver supply tray capable of automatically accommodating receiver sheets of various sizes, and method of assembling same.

PART LIST

10 . . . image forming apparatus
20 . . . image
30 . . . receiver sheet
32 . . . lateral marginal edge of receiver sheet
33 . . . rearwardly-facing marginal edge of receiver sheet
35 . . . stack of receiver sheets
40 . . . print head
50 . . . support
55 . . . first arrow
60 . . . nip
70 . . . donor supply spool
75 . . . second arrow
80 . . . donor ribbon
90 . . . donor take-up spool
100 . . . third arrow
110 . . . guide ramp
115 . . . guide roller
120*a/b/c* . . . tensioners
130 . . . picker mechanism
140 . . . picker roller
145 . . . fourth arrow
150 . . . motor
160 . . . output receptacle
170 . . . frame
180 . . . enclosure
185 . . . opening
190 . . . supply tray
200*a* . . . front sidewall
200*b* . . . rear sidewall
200*c* . . . first lateral sidewall
200*d* . . . second lateral sidewall
202 . . . spring
204 . . . support wall
205 . . . arrow
206 . . . ramp portion
208 . . . guide blocks
209 . . . alignment pillars
210 . . . floor
220 . . . cover plate
230 . . . first alignment member
235 . . . contact edge of first alignment member
240 . . . second alignment member
245 . . . contact of second alignment member
250 . . . third alignment member
255 . . . contact edge of third alignment member
260 . . . platen
265 . . . wing portions
270 . . . spring
280*a/b* . . . separation pawls
290 . . . lever arm
300 . . . first pivot pin

302 . . . slot
303 . . . side panel
305 . . . second pivot pin

What is claimed is:

1. An image forming apparatus capable of automatically accommodating a receiver having a predetermined size, comprising:

(a) a print head for printing an image on the receiver; and (b) a receiver supply tray associated with said print head for accepting the receiver, said supply tray including a plurality of resilient alignment members disposed to abut the marginal edge of the receiver for automatically accommodating the receiver size.

2. An image forming apparatus capable of automatically accommodating a receiver sheet having a predetermined size, said receiver sheet having a marginal edge, comprising:

(a) a print head for printing an image on the receiver sheet;

(b) a feeder mechanism disposed relative to said print head for feeding the receiver sheet to said print head; and (c) a receiver supply tray associated with said feeder mechanism for accepting the receiver sheet therein and for thereafter presenting the receiver sheet to said feeder mechanism, said supply tray adapted to automatically accommodate the receiver size, wherein said supply tray includes a plurality of resilient alignment members disposed to abut the marginal edge of the receiver sheet for aligning the receiver sheet with respect to said feeder mechanism.

3. The image forming apparatus of claim 2, wherein said alignment members are leaf springs.

4. For use in an image forming apparatus, a receiver supply tray capable of automatically accommodating a stack of receiver sheets having a predetermined size, each receiver sheet having a marginal edge, comprising:

(a) a housing;

(b) a platen connected to said housing for supporting the stack of receiver sheets thereon; and (c) a plurality of alignment members connected to said housing, said alignment members disposed to abut the marginal edge of each receiver sheet in the stack of receiver sheets for aligning the stack of receiver sheets with respect to said feeder mechanism.

5. The supply tray of claim 4, wherein said alignment members are leaf springs for resiliently supporting the receiver sheets thereon.

6. For use in an image forming apparatus, a receiver supply tray capable of automatically accommodating a stack of receiver sheets having a predetermined size, each receiver sheet having a first marginal edge and a second marginal edge, comprising:

(a) a housing having a rear wall, a sidewall perpendicular to the rear wall;

(b) a platen movably connected to said housing for supporting the stack of receiver sheets thereon; and (c) a plurality of leaf springs connected to said housing, a first one of said leaf springs disposed to abut the first marginal edge of each receiver sheet and a second one of said leaf springs disposed to abut the second marginal edge of each receiver sheet for aligning the stack of receiver sheets with respect to said feeder mechanism.

7. The supply tray of claim 6, wherein said leaf springs are bowed for obtaining a predetermined resiliency.

8. A method of assembling an image forming apparatus capable of automatically accommodating a receiver having a predetermined size, comprising the steps of:

(a) acquiring a print head for printing an image on the receiver; and (b) disposing at least one alignment member to abut the marginal edge of the receiver to automatically accommodate the receiver size.

9. A method of assembling an image forming apparatus capable of automatically accommodating a receiver sheet having a predetermined size, the receiver sheet having a marginal edge, comprising the steps of:

(a) disposing a feeder mechanism relative to a print head for feeding the receiver sheet to the print head; and (b) disposing at least one alignment member to abut the marginal edge of the receiver sheet for aligning the receiver sheet with respect to the feeder mechanism.

10. The method of claim 9, wherein the step of disposing the at least one alignment member comprises the step of disposing at least one leaf spring.

11. For use in association with an image forming apparatus, a method of assembling a receiver supply tray capable of automatically accommodating a stack of receiver sheets having a predetermined size, each receiver sheet having a marginal edge, comprising the steps of:

(a) connecting a platen to a housing for supporting the stack of receiver sheets thereon; and (b) connecting a plurality of alignment members to the housing, at least one of the alignment members disposed to abut the marginal edge of each receiver sheet in the stack of receiver sheets for aligning the stack of receiver sheets with respect to the feeder mechanism.

12. The supply tray of claim 11, wherein the step of connecting a plurality of alignment members comprises the step of connecting a plurality of leaf springs for resiliently supporting the receiver sheets thereon.

13. For use in association with an image forming apparatus, a method of assembling a receiver supply tray capable of automatically accommodating a stack of receiver sheets having a predetermined size, each receiver sheet having a first marginal edge and a second marginal edge, comprising the steps of:

(a) connecting a movable platen to a housing for supporting the stack of receiver sheets thereon, the housing having a rear wall and a sidewall perpendicular to the rear wall; and (b) connecting a plurality of leaf springs to the housing, a first one of the leaf springs disposed to abut the first marginal edge of each receiver sheet and a second one of the leaf springs disposed to abut the second marginal edge of each receiver sheet for aligning the stack of receiver sheets with respect to the feeder mechanism.

14. The method of claim 13, wherein the step of connecting a plurality of leaf springs comprises the step of disposing the leaf springs, so that the leaf springs are bowed for obtaining a predetermined resiliency.

* * * * *